US009199365B1

(12) United States Patent
Sim

(10) Patent No.: US 9,199,365 B1
(45) Date of Patent: Dec. 1, 2015

(54) VEHICLE BALL JOINT AND SUSPENSION REMOVAL TOOL

(71) Applicant: Henry Sim, Kaneohe, HI (US)

(72) Inventor: Henry Sim, Kaneohe, HI (US)

( * ) Notice: Subject to any disclaimer, the term of this patent is extended or adjusted under 35 U.S.C. 154(b) by 358 days.

(21) Appl. No.: 13/916,075

(22) Filed: Jun. 12, 2013

(51) Int. Cl.
*B25B 27/00* (2006.01)
*B66F 15/00* (2006.01)

(52) U.S. Cl.
CPC ..... *B25B 27/0035* (2013.01); *B66F 15/00* (2013.01)

(58) Field of Classification Search
CPC ..... B25B 27/00; B25B 27/0035; B66F 15/00
USPC ..... 254/30
See application file for complete search history.

(56) References Cited

U.S. PATENT DOCUMENTS

| | | | | | |
|---|---|---|---|---|---|
| 1,372,389 | A | * | 3/1921 | Bailey et al. | 29/213.1 |
| 1,419,023 | A | * | 6/1922 | Clifton | 254/36 |
| 2,624,544 | A | | 1/1953 | Graham | |
| 2,681,791 | A | | 6/1954 | Hahn | |
| 2,896,910 | A | | 7/1959 | Cooper | |
| 3,719,346 | A | * | 3/1973 | Bohannon et al. | 73/865.9 |
| 3,817,549 | A | * | 6/1974 | Bohannon et al. | 280/124.141 |
| 4,039,140 | A | | 8/1977 | Pulliam | |
| 4,634,166 | A | * | 1/1987 | Pool | 294/103.1 |
| 4,826,136 | A | | 5/1989 | Thomas | |
| 4,977,660 | A | * | 12/1990 | Maynard | 29/251 |
| 4,999,898 | A | | 3/1991 | Schmeling | |
| 5,020,202 | A | | 6/1991 | Turrell | |
| D424,901 | S | | 12/1993 | Landry | |
| 5,271,115 | A | | 12/1993 | Senters | |
| 5,626,063 | A | | 5/1997 | Kosbab | |
| 5,832,581 | A | | 11/1998 | Barthuli | |
| 5,909,910 | A | | 6/1999 | Shaffer | |
| 6,113,074 | A | | 9/2000 | Foley | |
| 6,131,883 | A | * | 10/2000 | Spears et al. | 254/10.5 |
| 6,634,620 | B2 | | 10/2003 | Sim | |
| 7,634,845 | B1 | * | 12/2009 | Sim | 29/267 |
| 8,375,545 | B2 | | 2/2013 | Sim | |
| 2003/0075710 | A1 | * | 4/2003 | Sim | 254/131 |
| 2008/0277634 | A1 | * | 11/2008 | Helwick | 254/10.5 |
| 2010/0140574 | A1 | * | 6/2010 | Sim | 254/129 |

FOREIGN PATENT DOCUMENTS

| | | | | |
|---|---|---|---|---|
| GB | 2461288 | A * | 12/2009 | B25B 27/00 |

* cited by examiner

*Primary Examiner* — Lee D Wilson
*Assistant Examiner* — Tyrone V Hall, Jr.
(74) *Attorney, Agent, or Firm* — Michael I. Kroll

(57) ABSTRACT

A tool for gaining leverage and facilitating the removal of a motor vehicle's ball joints during service. The tool comprises a bar with a gusset that provides for an attachable/detachable tool head that may be rotated 180 degrees, set to a left or right hook, and or moved in placement from front to back of the bars end. Additionally the present invention has a chain hookup set for gaining better access to the ball joints and a removable foam cover to provide for a more comfortable use while straddling the bar.

8 Claims, 19 Drawing Sheets

VEHICLE BALL JOINT AND SUSPENSION REMOVAL TOOL

BACKGROUND OF THE INVENTION

1. Field of the Invention

Figure 1:
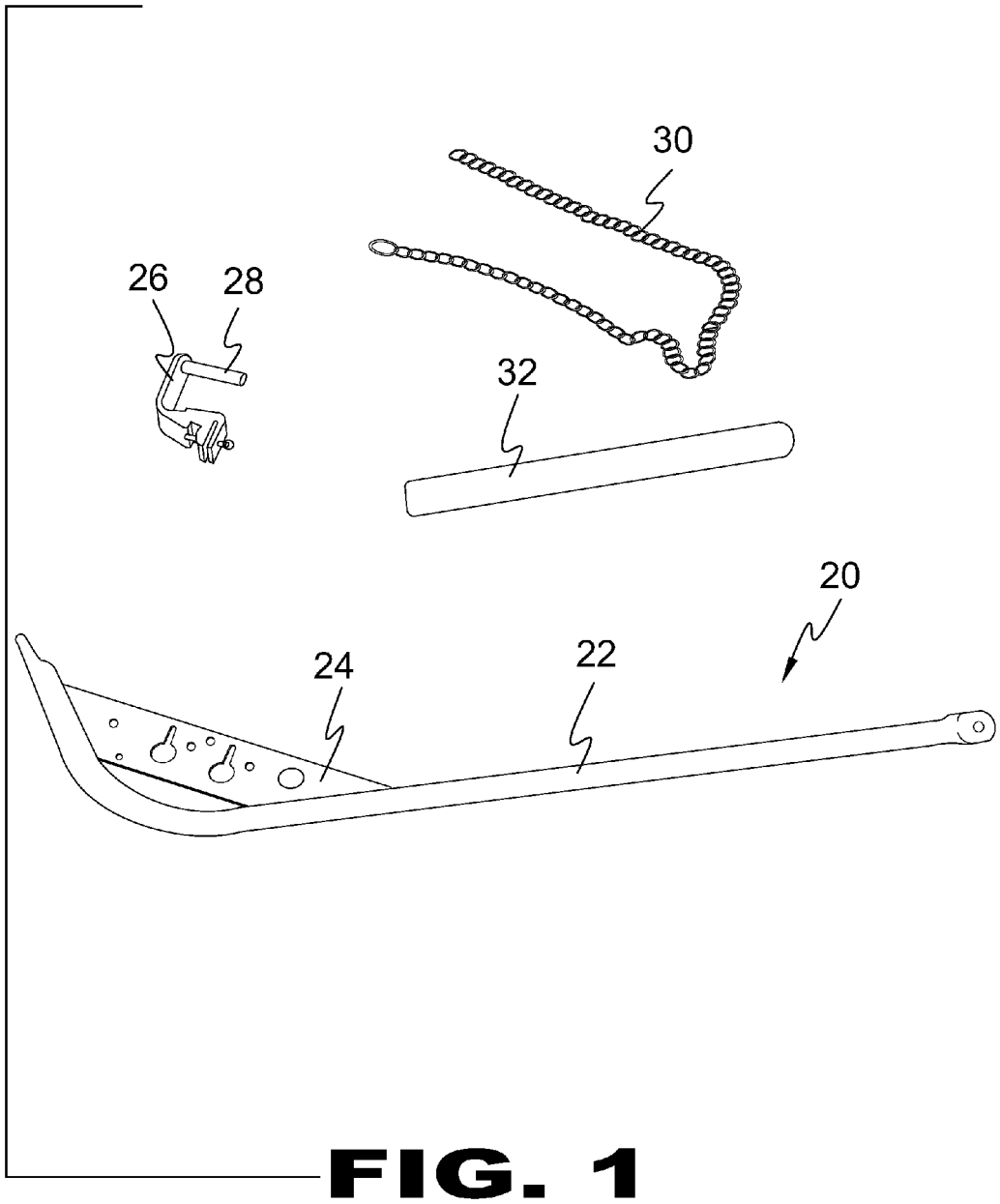

The present invention relates generally to tools and, more specifically, to a tool for gaining leverage and facilitating the removal of a vehicles ball joints during service. Comprising the present invention is a bar with a gusset that provides for an attachable/detachable tool head that may be rotated 180 degrees, set to a left or right hook, and or moved in placement from front to back of said bars end. Additionally the present invention has a chain hookup set for gaining better access to the joints and a removable foam cover to provide for more comfortable use while straddling the bar.

2. Description of the Prior Art

There are other tools which provide for vehicle suspension. While these tools may be suitable for the purposes for which they where designed, they would not be as suitable for the purposes of the present invention as heretofore described.

It is thus desirable to provide a prying bar having a detachable tool head that can be rotated 180° or detached wherethen a chain can be attached to the pry bar for use with suspensions where the hook cannot grab onto because of an unusual geometry.

SUMMARY OF THE PRESENT INVENTION

A primary object of the present invention is to provide a tool for the removal of ball joints from vehicle suspensions having a bar and gusset that work with a plurality of tool heads to gain greater access and easier removal of said ball joints.

Another object of the present invention is to provide a tool for the removal of ball joints having a tool head that is 180 degrees rotatable and can be moved from front to back.

Yet another object of the present invention is to provide a tool for removing ball joints having a chain hookup set that can be attached to the tool to allow the user to gain better access to the ball joint.

Still yet another object of the present invention is provide a tool for removing ball joints having a padded handle for more comfortable use while straddling the bar.

Another object of the present invention is to provide a tool for removing ball joints having a right or left facing hook for grabbing the ball joint and aiding its removal.

Additional objects of the present invention will appear as the description proceeds.

The present invention overcomes the shortcomings of the prior art by providing a tool for the removal of ball joints from vehicle suspensions having a bar and gusset that work with a plurality of tool heads that may be rotated 180 degrees, moved to being either a left or right hook, or moved forward or back along its end to gain greater access and easier removal of said ball joints. Additionally the present invention has a chain hookup that allows for the user to gain greater access along with a padded handle for providing the user additional comfort while straddling the bar during use.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Figure 2:
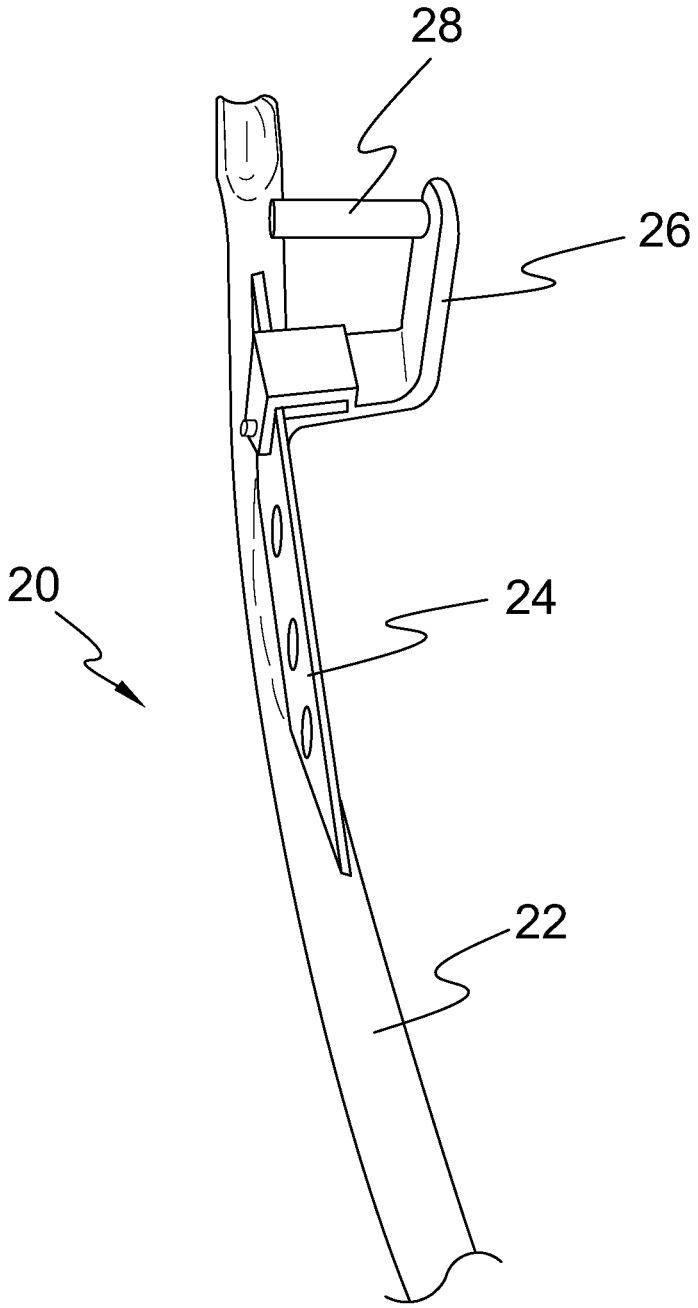
Figure 3:
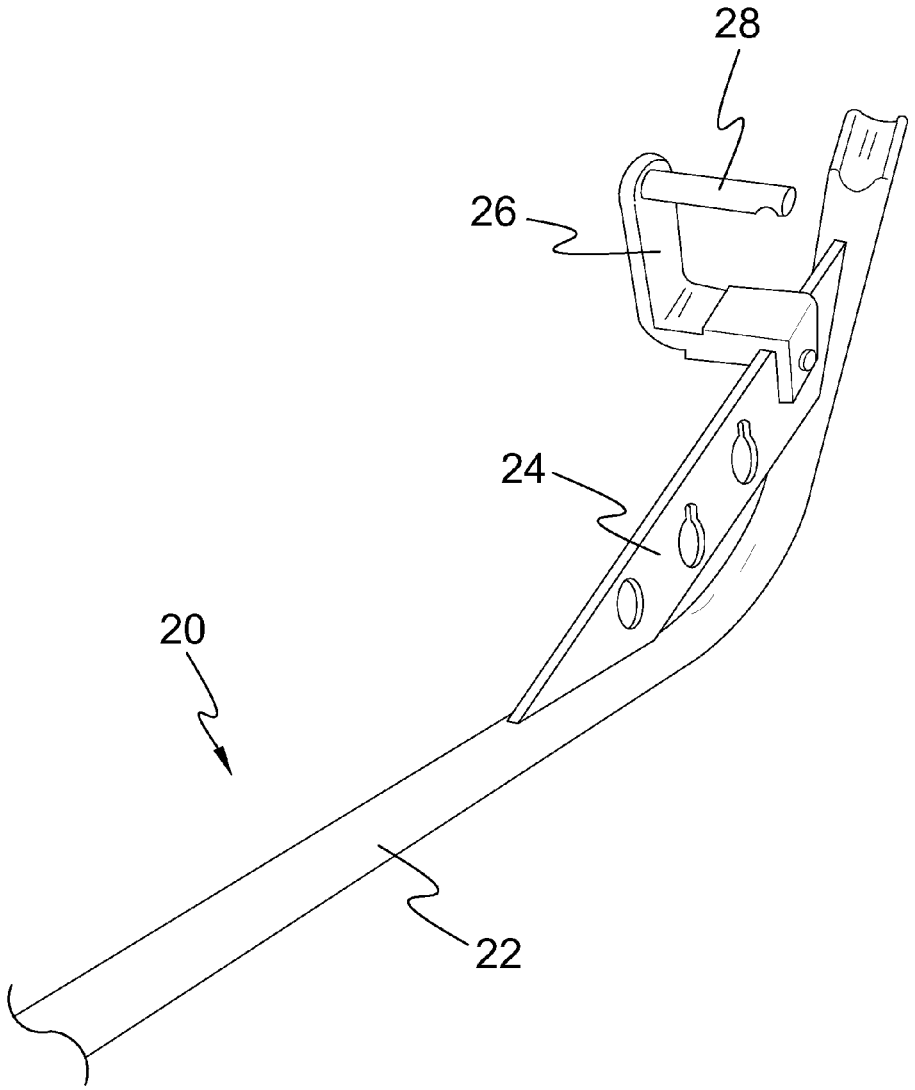
Figure 4:
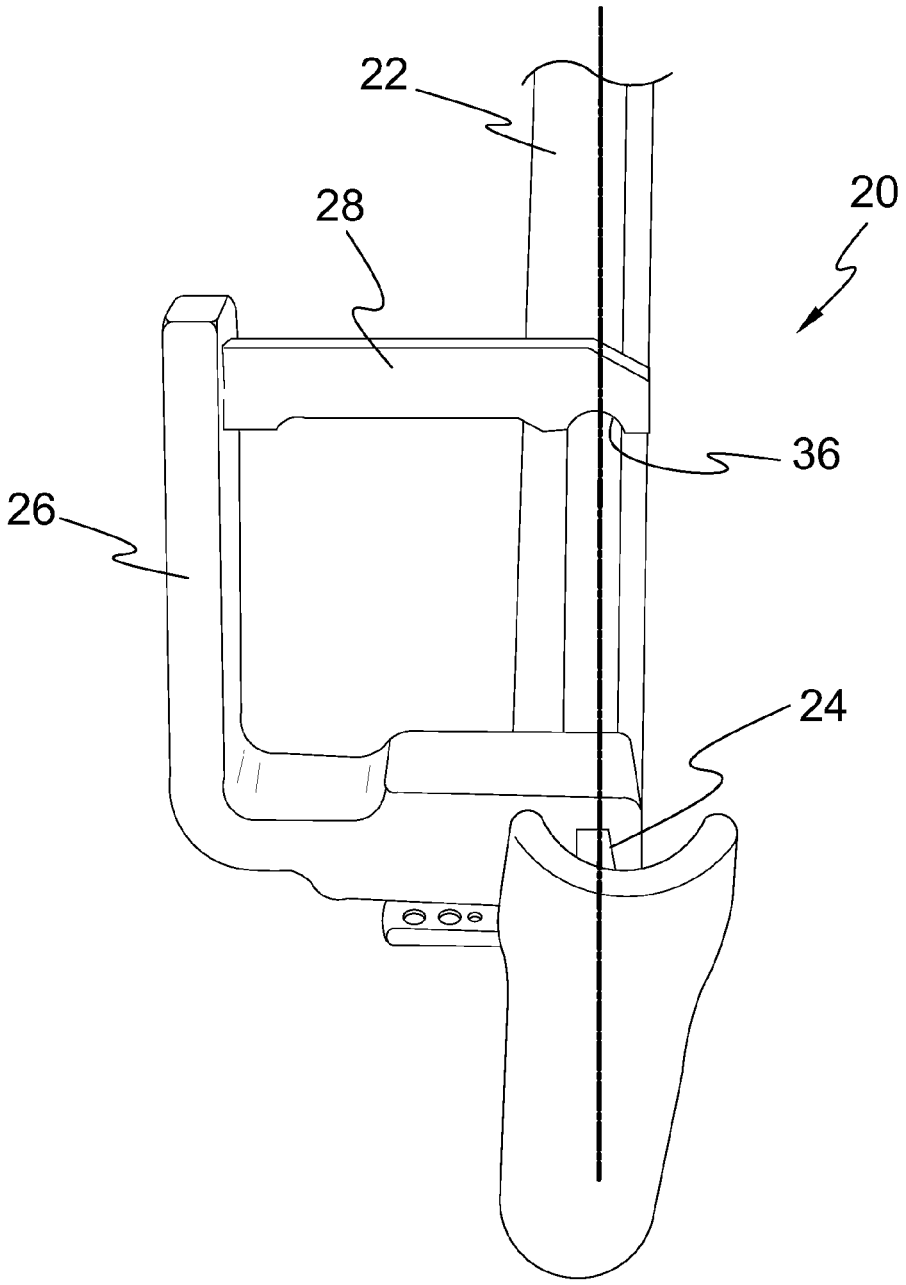
Figure 5:
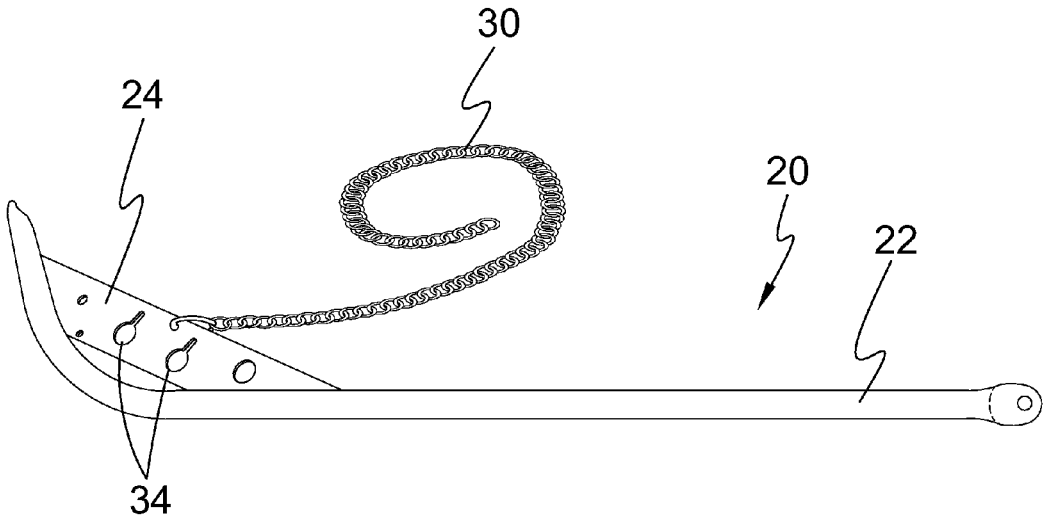
Figure 6:
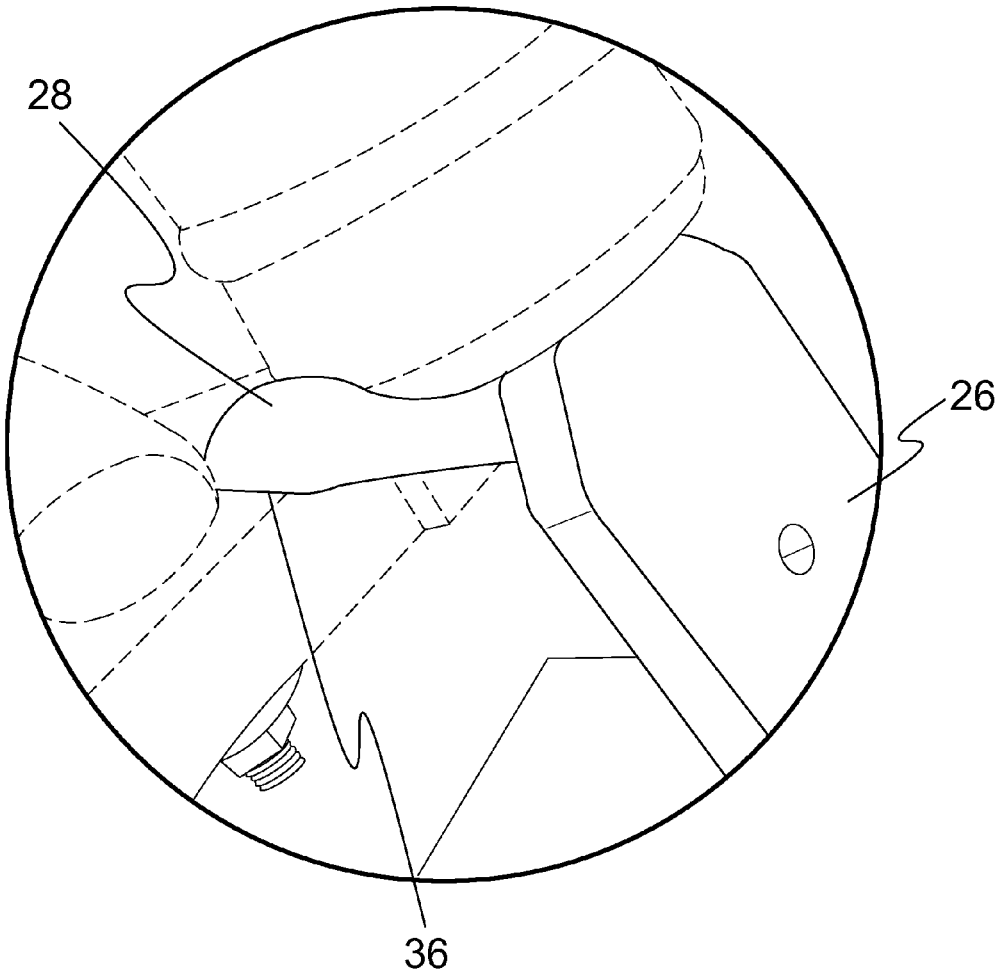
Figure 7:
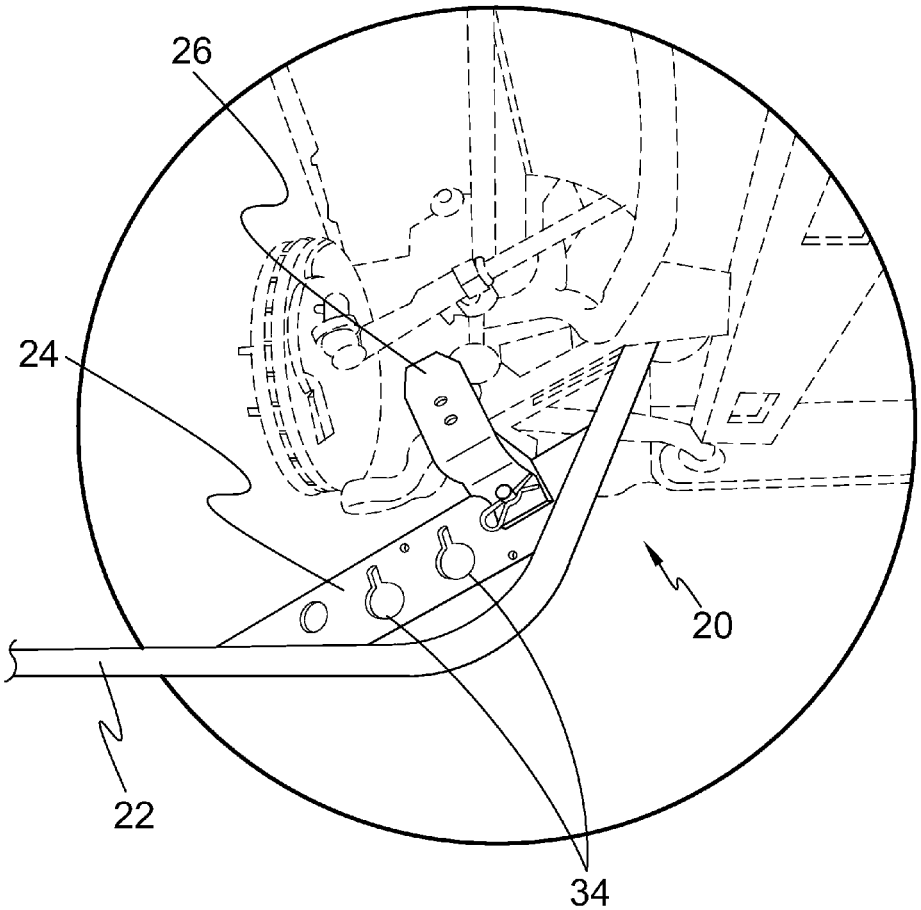
Figure 8:
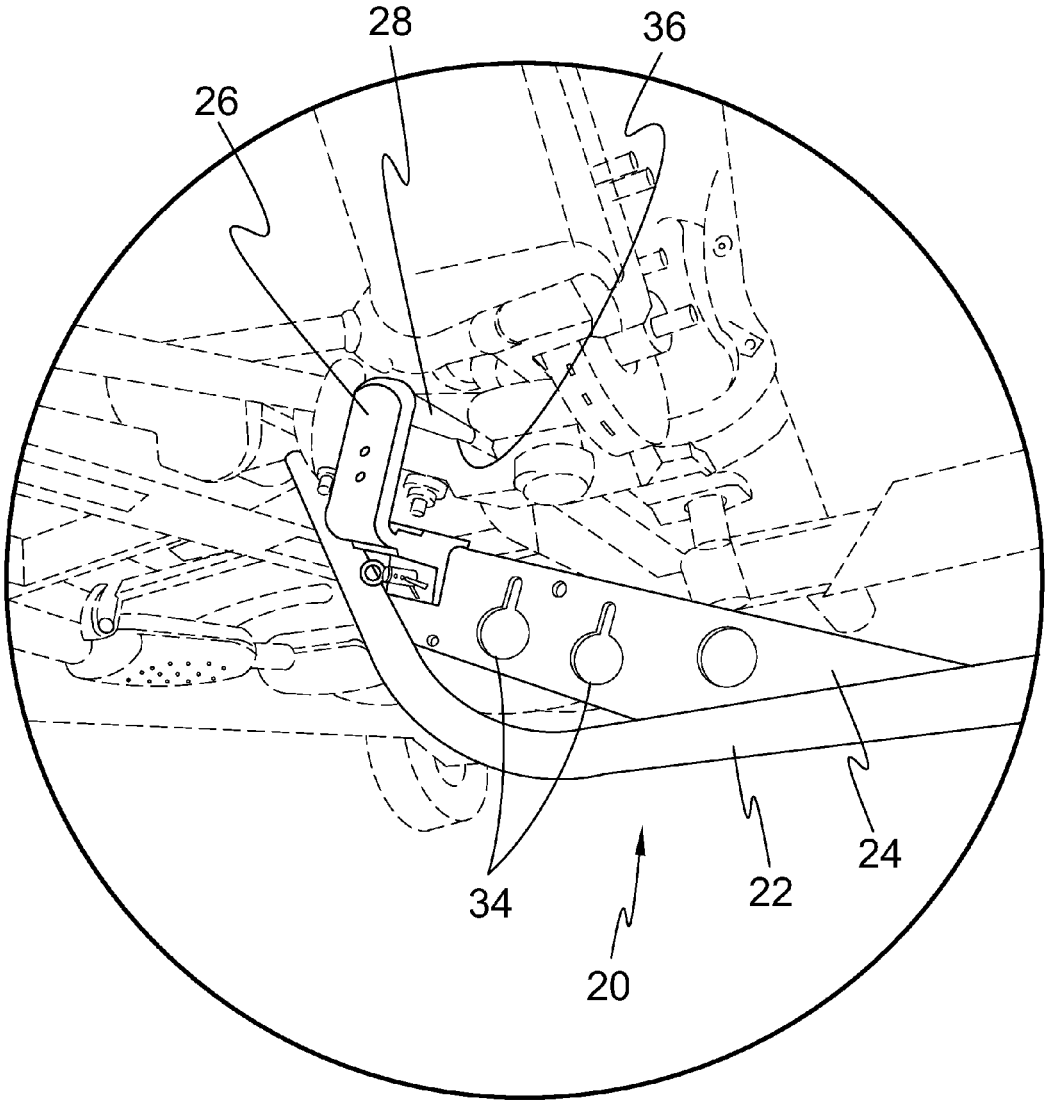
Figure 9:
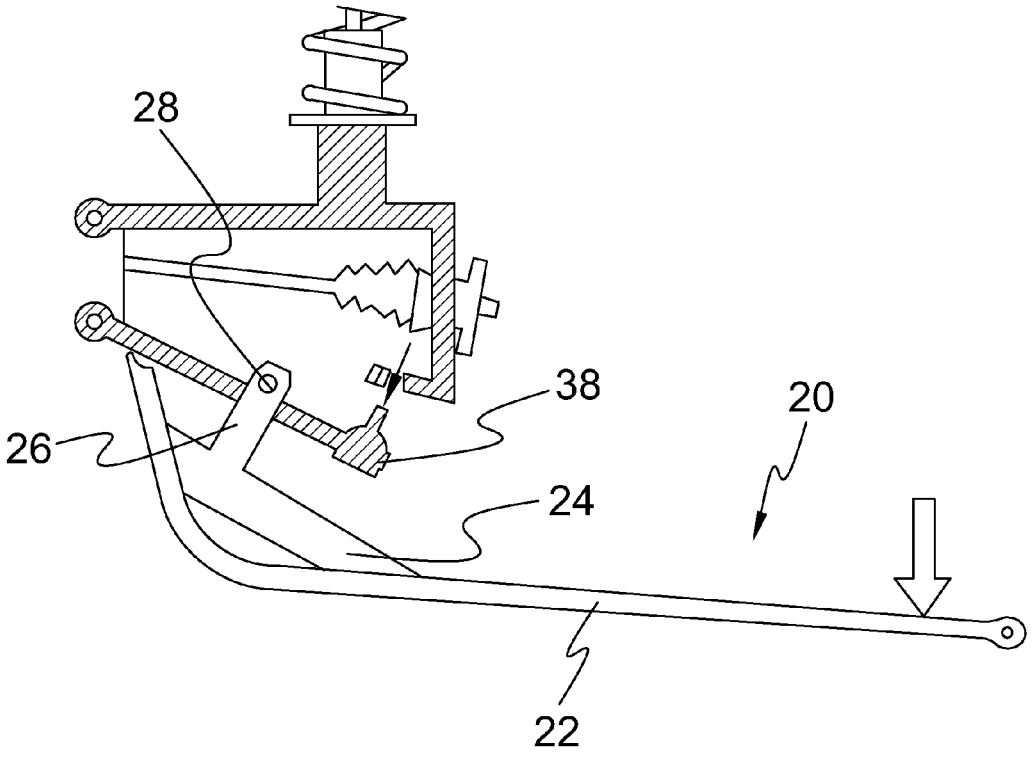
Figure 10:
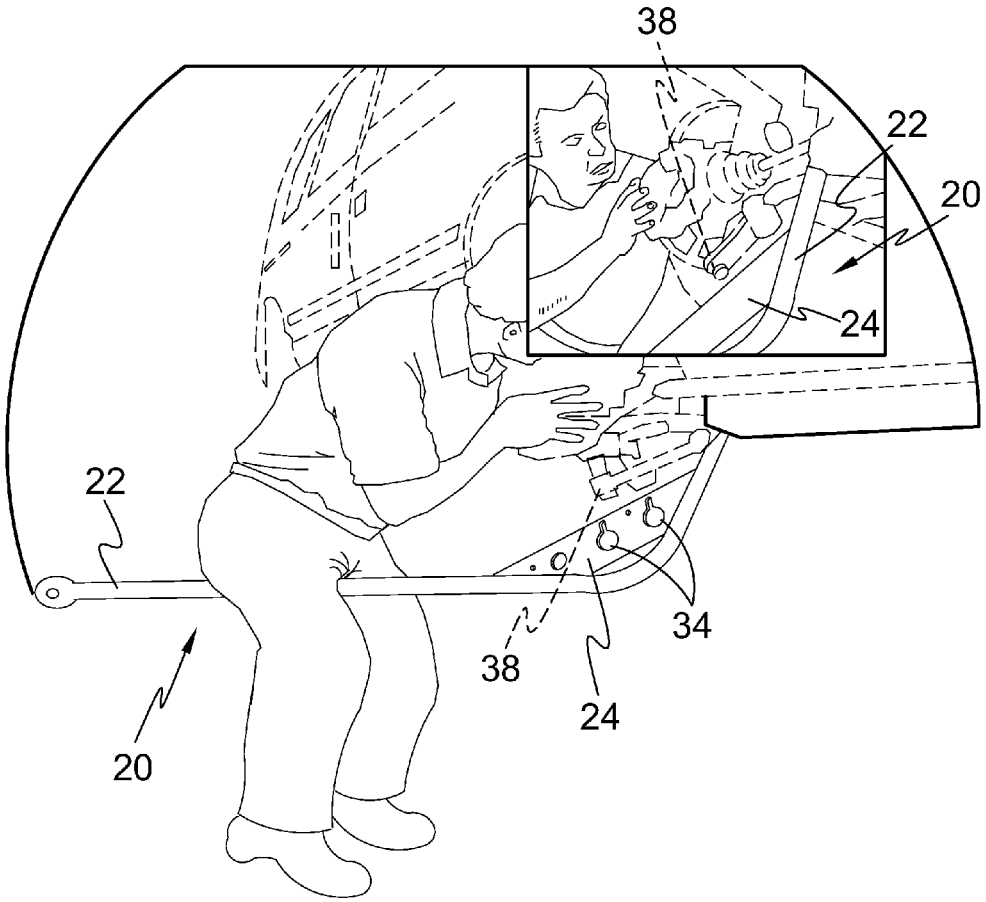
Figure 11:
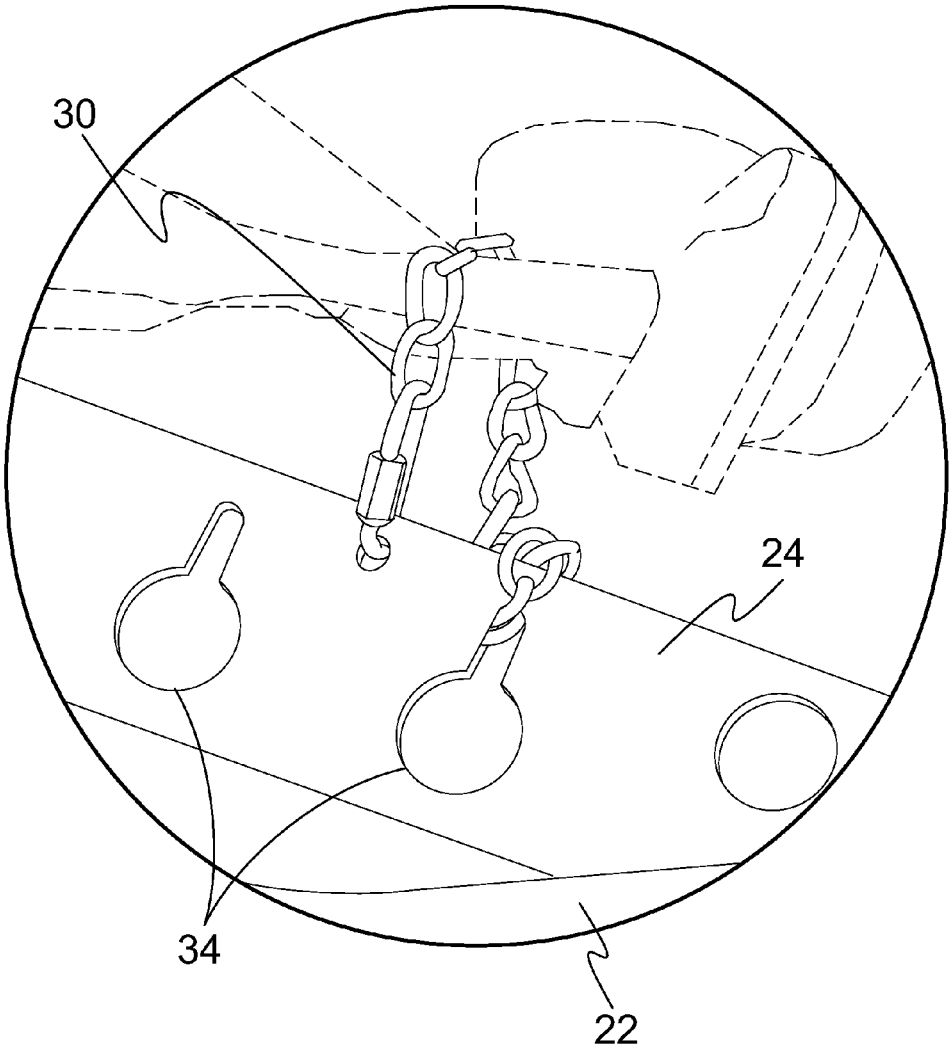
Figure 12:
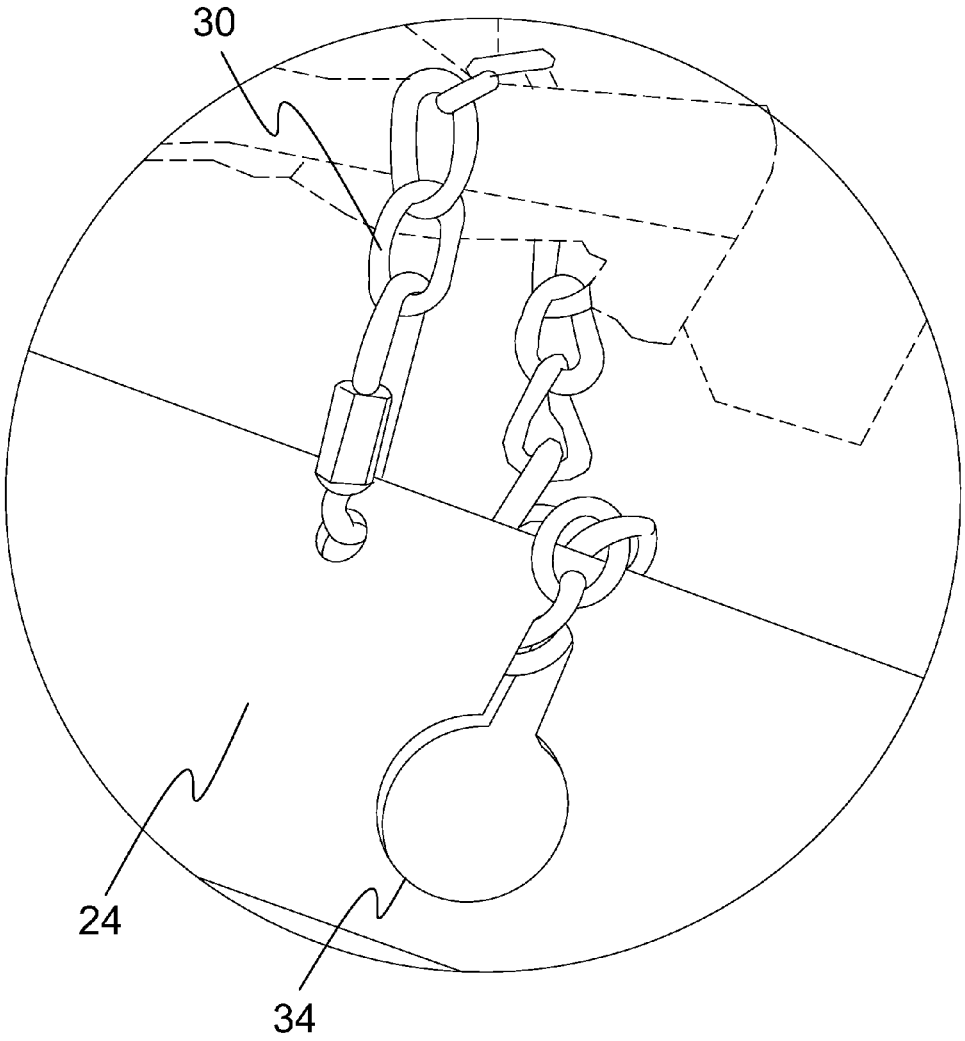
Figure 13:
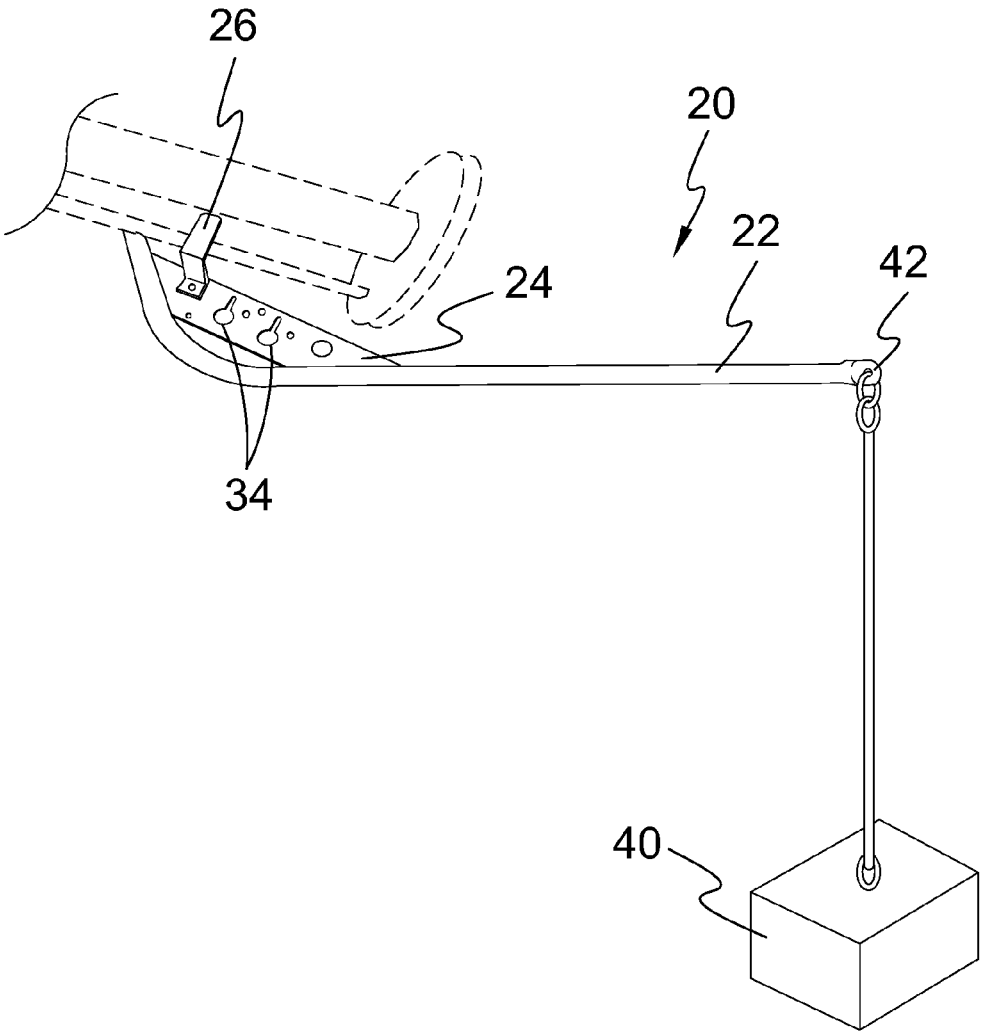
Figure 14:
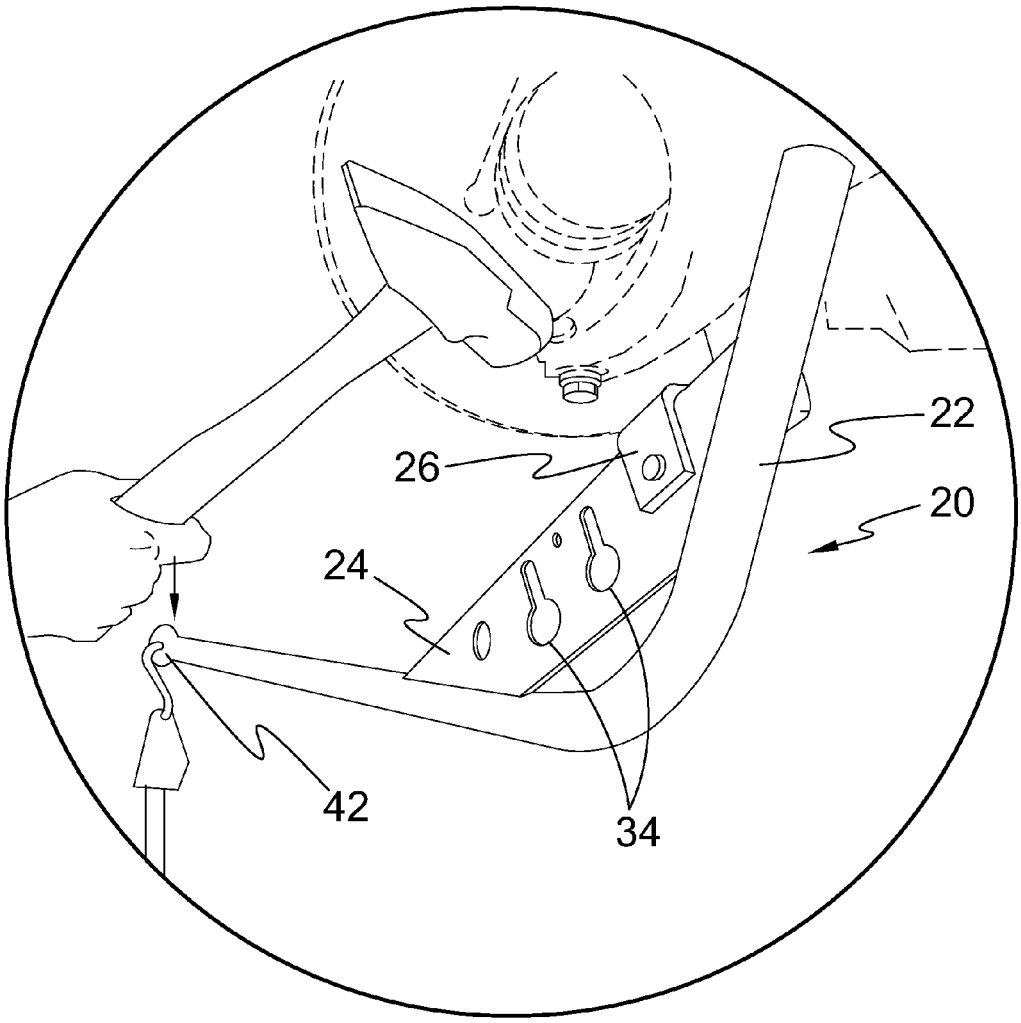
Figure 15:
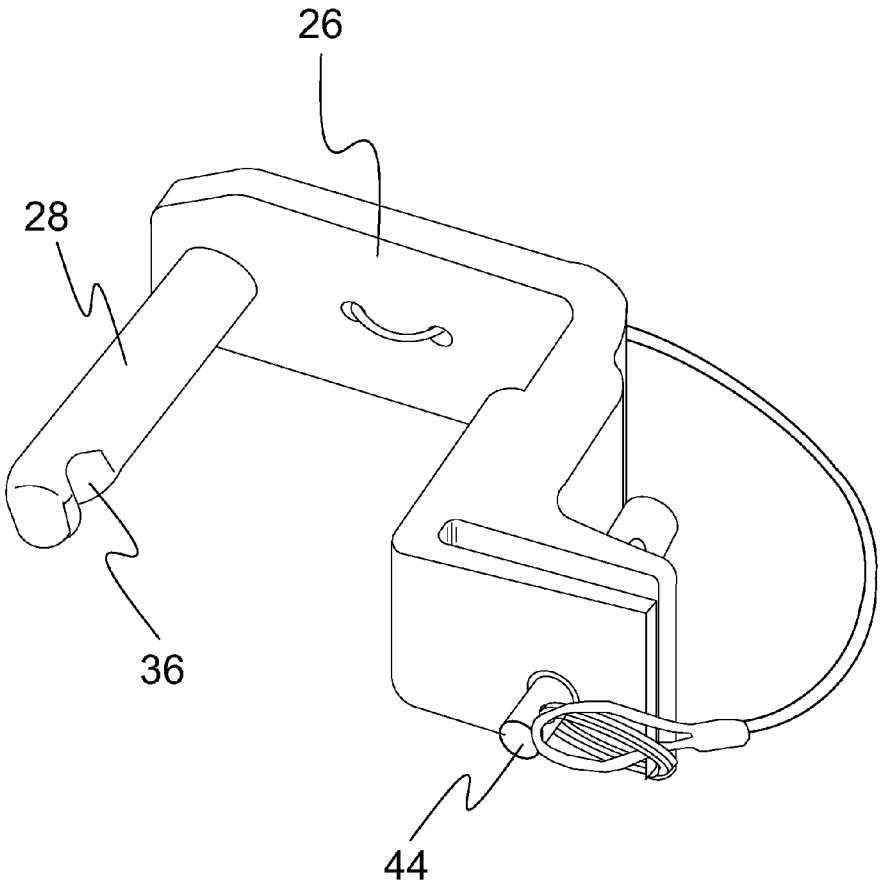
Figure 16:
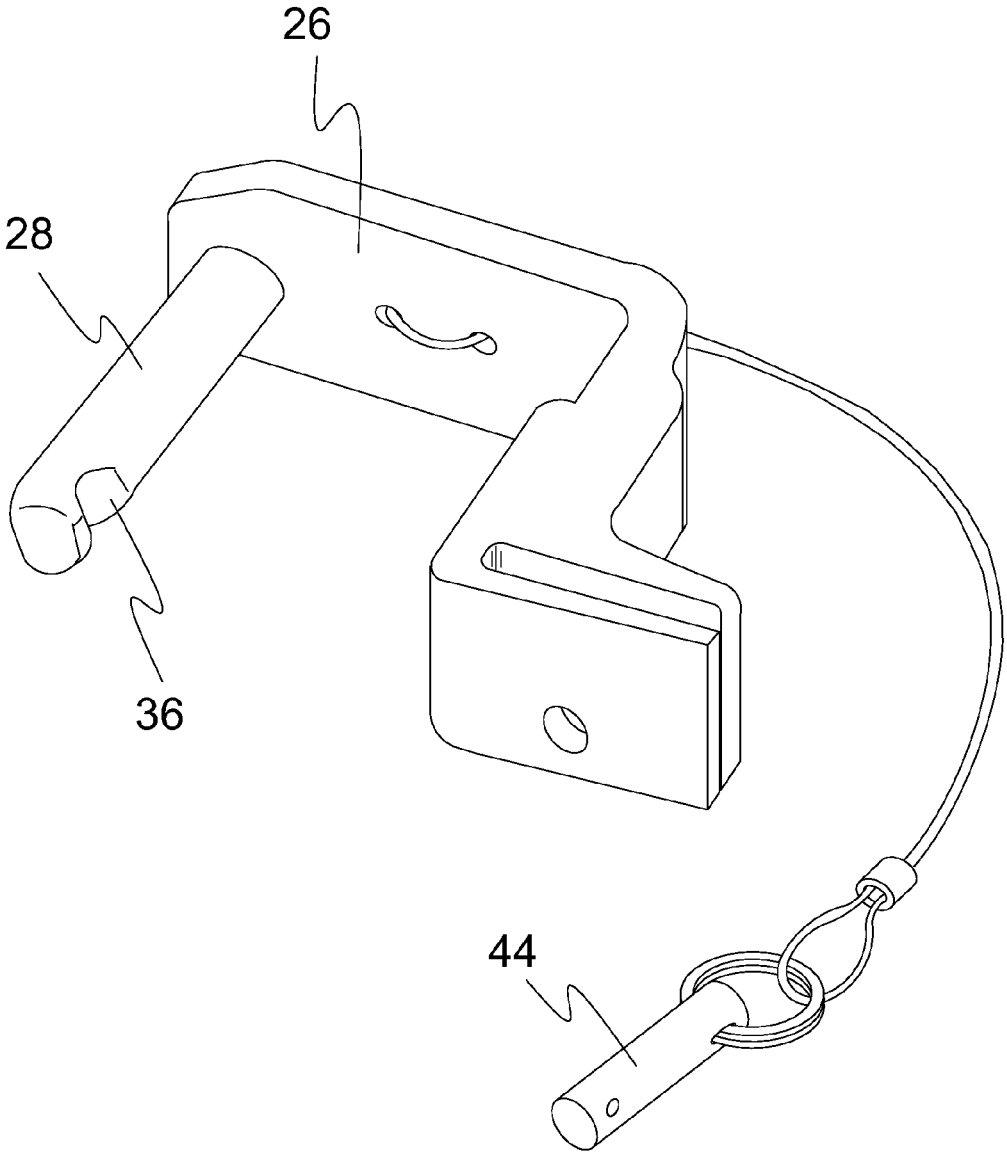
Figure 17:
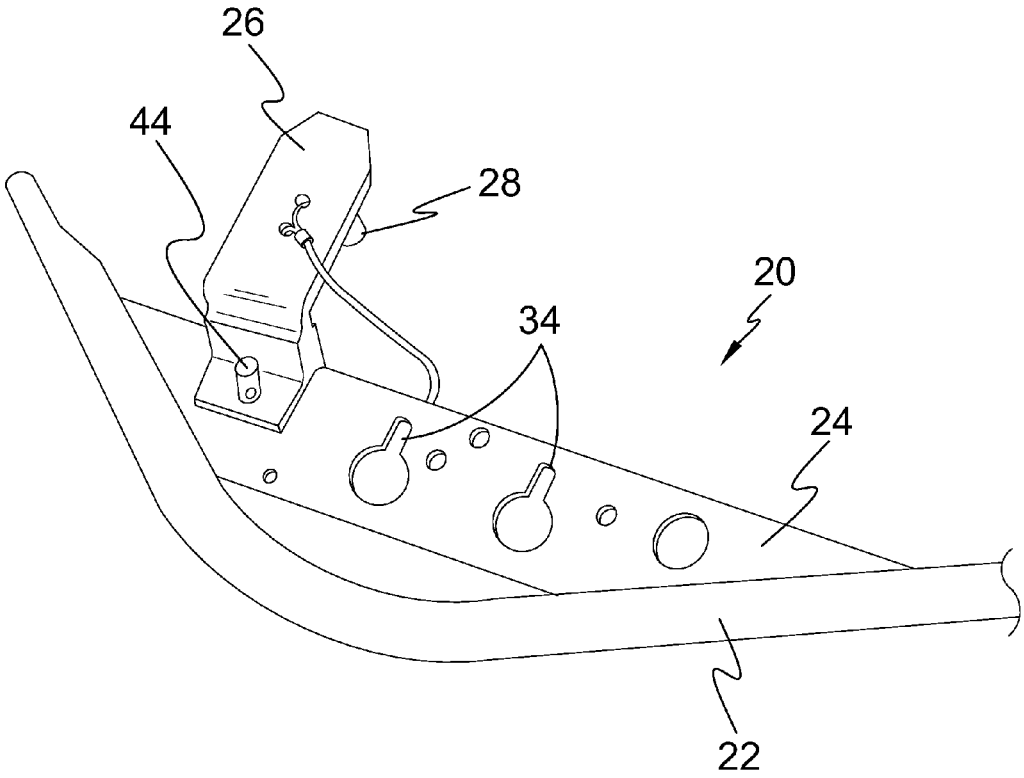
Figure 18:
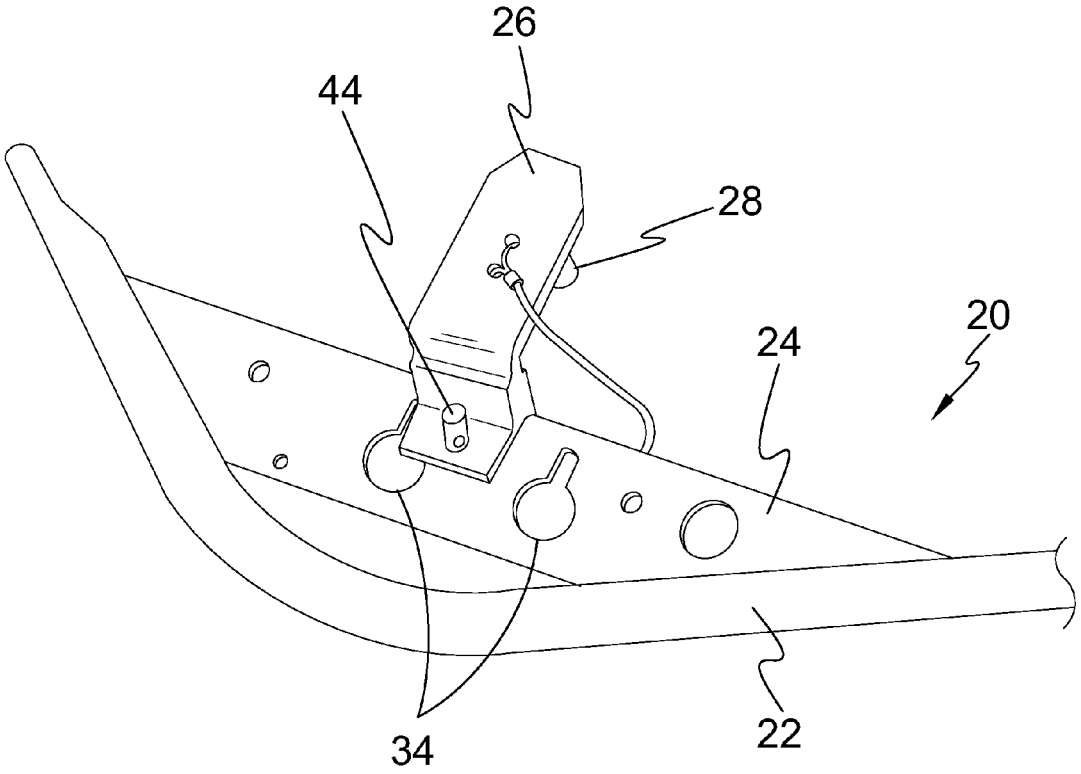
Figure 19:
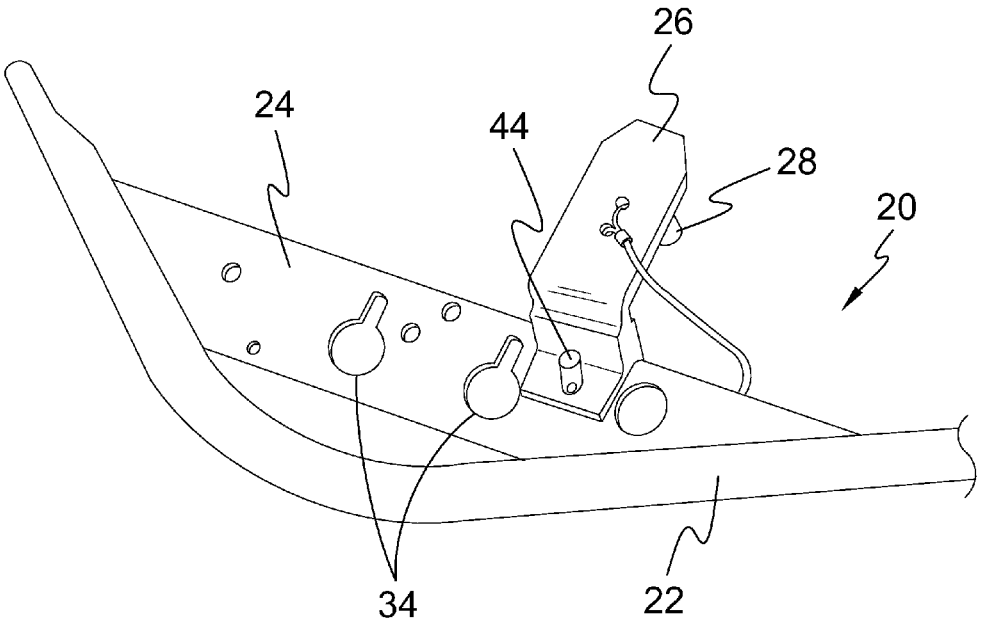

In order that the invention may be more fully understood, it will now be described, by way of example, with reference to the accompanying drawing in which:

FIG. 1 is a perspective view of the present invention.
FIG. 2 is a perspective view of the present invention.
FIG. 3 is a perspective view of the present invention.
FIG. 4 is a perspective view of the present invention.
FIG. 5 is a perspective view of the present invention.
FIG. 6 is an illustrative view of the present invention.
FIG. 7 is an illustrative view of the present invention.
FIG. 8 is an illustrative view of the present invention.
FIG. 9 is a perspective view of the present invention.
FIG. 10 is an illustrative view of the present invention.
FIG. 11 is an illustrative view of the present invention.
FIG. 12 is an illustrative view of the present invention.
FIG. 13 is an illustrative view of the present invention.
FIG. 14 is an illustrative view of the present invention.
FIG. 15 is a perspective view of the present invention.
FIG. 16 is a perspective view of the present invention.
FIG. 17 is a perspective view of the present invention.
FIG. 18 is a perspective view of the present invention.
FIG. 19 is a perspective view of the present invention.

DESCRIPTION OF THE REFERENCED NUMERALS

Turning now descriptively to the drawings, in which similar reference characters denote similar elements throughout the several views, the Figures illustrate the vehicle ball joint and suspension removal tool of the present invention. With regard to the reference numerals used, the following numbering is used throughout the various drawing figures.

20 tool
22 bar of tool 20
24 gusset of tool 20
26 tool head of tool 20
28 hook on tool head 26
30 chain attachment of tool 20
32 foam sleeve of tool 20
34 key slot in gusset 20
36 notch on hook 28
38 ball joint
40 weight of tool 20
42 hole in bar 22
44' ball detent clevis pin for tool head 26

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is a perspective view of the present invention. Shown are the main components that comprise the present invention, a tool 20 for the removal of vehicle ball joints. All the component parts, the bar 22 with the gusset 24, which is the heart of the tool 20, allows the tool 20 to work as intended. The tool head 26 with the hook 28 is detachable, it can be turned 180 degrees and also relocated forward and back. A chain attachment 30 can be used with or without the tool head 26 for suspensions with unusual geometry where the hook 28 cannot grab on well. A foam sleeve 32 can be slipped over the bar 22 to provide more comfort when straddling the bar 22.

Referring to FIG. 2, shown is a perspective view of the present invention. Shown is the left facing hook 28 setup.

Referring to FIG. 3, shown is a perspective view of the present invention. Shown is the right facing hook 28 setup.

Referring to FIG. 4, shown is a perspective view of the present invention. The notch 36 in the hook 28 is in the same plane as the center line of the tool 20 to prevent rotation of the tool 20.

Referring to FIG. 5, shown is a perspective view of the present invention. A new feature is the chain attachment 30, to be used when the hook 28 attachment fails to gain good access. Two key slots 34 are provided for the attachment of the chain 30, whichever one fits best, loop chain 30 over the gusset 24 to prevent slippage.

Referring to FIG. 6, shown is an illustrative view of the present invention. The notch 36 on the hook 28 is used to engage a groove or protrusion on the control arm for a secure grip.

Referring to FIG. 7, shown is an illustrative view of the present invention. With the capability of switching between right and left facing hook 28 will allow the same approach on both sides of the vehicle if access is difficult on one of them.

Referring to FIG. 8, shown is an illustrative view of the present invention. With the capability of switching between right and left facing hook 28 will allow the same approach on both sides of the vehicle if access is difficult on one of them.

Referring to FIG. 9, shown is a perspective view of the present invention. This illustration shows how the tool 20 is used, disengaging a ball joint 38 with the tool 20.

Referring to FIG. 10, shown is an illustrative view of the present invention. This illustration shows how the tool 20 can be straddled to control the movement of the arm, leaving both hands free to maneuver parts, allowing for a one man operation. Straddling the bar 22 and using body movement to control the bar 22 allows both hands to be free to maneuver the affected components.

Referring to FIG. 11, shown is an illustrative view of the present invention. This illustration shows how the chain 30 can be used for difficult applications.

Referring to FIG. 12, shown is an illustrative view of the present invention. This chain attachment 30 can be used when the hook 28 attachment fails to gain good access. The user must be sure to loop the chain 30 around to prevent slippage.

Referring to FIG. 13, shown is an illustrative view of the present invention. Hanging a weight 40 from the hole 42 at the end of the bar 22 will eliminate the need of a second person pressing down on the bar 22 when breaking loose ball joints 38, allowing for a one man operation. The bar 22 is used only to apply pressure to separate the parts while the ball joint mounting boss is struck with a well directed hammer blow to allow the parts to separate, without damaging the grease boot. At no time should any attempt be made to separate the parts with the bar 22 alone and without hammer blows.

Referring to FIG. 14, shown is an illustrative view of the present invention. Using the third hand setup will break loose the ball joint 38. Hanging a weight 40 from the hole 42 at the end of the bar 22 will eliminate the need of a second person pressing down on the bar 22 when breaking loose ball joints 38, allowing for a one man operation.

Referring to FIG. 15, shown is a perspective view of the present invention. Shown is the detachable hook tool head 26 having a ball detent clevis pin 44 that helps make quick change.

Referring to FIG. 16, shown is a perspective view of the present invention. Shown is the detachable hook tool head 26 having a ball detent clevis pin 44 removed. The clevis pin 44 is tethered to the tool head 26.

Referring to FIG. 17, shown is a perspective view of the present invention. Shown is the tool head 26 in a first position.

Referring to FIG. 18, shown is a perspective view of the present invention. Shown is the tool head 26 in a second position.

Referring to FIG. 19, shown is a perspective view of the present invention. Shown is the tool head 26 in a third position.

What is claimed is new and desired to be protected by Letters Patent is set forth in the appended claims:

1. A tool for removing a ball joint from a suspension system in a motor vehicle, comprising:

a) an elongated bar forming a handle portion having a bend at one end extending into an arm portion;

b) the arm portion having an end with a contour face to engage with a part of the suspension system in the motor vehicle;

c) a gusset fixed between the handle portion and the arm portion of the elongated bar;

d) a tool head adjustably attached onto the gusset, whereby the tool head can be turned 180 degrees and positioned forwardly and rearwardly along the gusset;

e) a hook extending horizontally from the tool head; and f) the hook having a notch formed adjacent on a free end for gripping a lower control arm of the suspension system in the motor vehicle to help a person in removing the ball joint.

2. The tool as recited in claim 1, wherein the gusset has a plurality of spaced apart apertures and key slots therealong.

3. The tool as recited in claim 2, wherein the tool head comprises:

a) a generally L-shaped member having a vertical leg and a horizontal leg, whereby the hook extends perpendicular out from the vertical leg;

b) an inverted U-shaped bracket on the underside of the horizontal leg, the bracket having two parallel spaced apart arms, in which each arm has an aligned hole, the arms of the U-shaped bracket slideably engaged with the gusset; and c) a clevis pin which fits through the holes in the arms of the bracket and into any one of the apertures in the gusset.

4. The tool as recited in claim 2, further comprising a chain attachment that can be wrapped about a part of the suspension system in the motor vehicle and connect to any one of the apertures and key slots in the gusset when the hook on the tool head fails to gain good access to the suspension system.

5. The tool as recited in claim 1, further comprising a foam sleeve that can be slipped over the handle portion of the elongated bar to provide more comfort when the person straddles the handle portion.

6. The tool as recited in claim 1, further comprising:

a) the handle portion of the elongated bar having an eyelet formed on a distal end;

b) a line attached at a first end to the eyelet; and c) a weight attached to a second end of the line to eliminate the need of a second person to press down on the handle portion when breaking loose the ball joint.

7. The tool as recited in claim 3, wherein the clevis pin comprises a ball detent to allow for a quick removal of the clevis pin from the bracket of the tool head and the gusset.

8. The tool as recited in claim 7, further comprising a tether extending between the clevis pin and the vertical arm of the L-shaped member of the tool head to prevent loss of the clevis pin.

* * * * *